US009044928B2

(12) United States Patent
Warmus

(10) Patent No.: US 9,044,928 B2
(45) Date of Patent: Jun. 2, 2015

(54) MAILING LINES AND RELATED METHODS

(71) Applicant: R. R. Donnelley & Sons Company, Chicago, IL (US)

(72) Inventor: James Warmus, La Grange, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 79 days.

(21) Appl. No.: 13/862,068

(22) Filed: Apr. 12, 2013

(65) Prior Publication Data

US 2013/0269606 A1 Oct. 17, 2013

Related U.S. Application Data

(60) Provisional application No. 61/623,368, filed on Apr. 12, 2012.

(51) Int. Cl.

| | |
|---|---|
| ***B41J 13/08*** | (2006.01) |
| ***B41J 3/28*** | (2006.01) |
| ***B41J 11/06*** | (2006.01) |
| ***B41F 17/02*** | (2006.01) |
| ***B41J 11/00*** | (2006.01) |
| ***B42C 19/04*** | (2006.01) |
| ***B42C 19/08*** | (2006.01) |

(52) U.S. Cl.

CPC ..... *B41F 17/02* (2013.01); *B41J 11/0035* (2013.01); *B41J 13/08* (2013.01); *B41J 11/06* (2013.01); *B41J 3/28* (2013.01); *B42C 19/04* (2013.01); *B42C 19/08* (2013.01)

(58) Field of Classification Search

CPC ..... B41J 13/08; B41J 11/06; B41J 11/0035; B41J 3/28; B41F 17/02

USPC ..... 400/24, 25, 56, 58; 270/1.02; 347/8

See application file for complete search history.

(56) References Cited

U.S. PATENT DOCUMENTS

| | | | | |
|---|---|---|---|---|
| 4,821,049 | A * | 4/1989 | Eckl | 346/134 |
| 5,467,973 | A * | 11/1995 | Graushar et al. | 270/1.02 |
| 5,854,643 | A * | 12/1998 | Katsuyama | 347/8 |
| 2011/0074844 | A1 * | 3/2011 | Holbrook et al. | 347/8 |

FOREIGN PATENT DOCUMENTS

| | | | | |
|---|---|---|---|---|
| FR | 2742693 | A1 * | 6/1997 | B41J 13/12 |
| FR | 2788506 | A1 * | 7/2000 | B65H 5/06 |

* cited by examiner

*Primary Examiner* — Daniel J Colilla

(74) *Attorney, Agent, or Firm* — Hanley, Flight & Zimmerman, LLC

(57) ABSTRACT

Mailing lines and related methods are disclosed. An example book addresser includes a print head to address varying thickness books and a lift movable relative to the print head between a first position and a second position to substantially maintain a distance between the print head and the varying thickness books.

17 Claims, 8 Drawing Sheets

MAILING LINES AND RELATED METHODS

RELATED APPLICATION

This patent claims priority to U.S. Provisional application No. 61/623,368 filed Apr. 12, 2012, which is hereby incorporated herein by reference in its entirety.

FIELD OF THE DISCLOSURE

This patent relates generally to binding lines, and, more particularly, to systems and methods to produce and address a plurality of different books.

BACKGROUND

Postal services apply postal rate discounts to individuals and/or companies that presort mail to a particular presort level. The presort levels may be associated with mail being bundled together having the same carrier route number, the same five digit postal code mailing address, the same first three digits of the postal code mailing address or the same state or provincial mailing address. Each presort level may have a different postage rate. For example, the cost of postage may decrease depending on the number of pieces of mail presorted and/or the presort level achieved. Additionally, a plurality of different publications can be bundled together to increase the number of publications that qualify for a lower cost postage presort rate.

DETAILED DESCRIPTION

Figure 1:
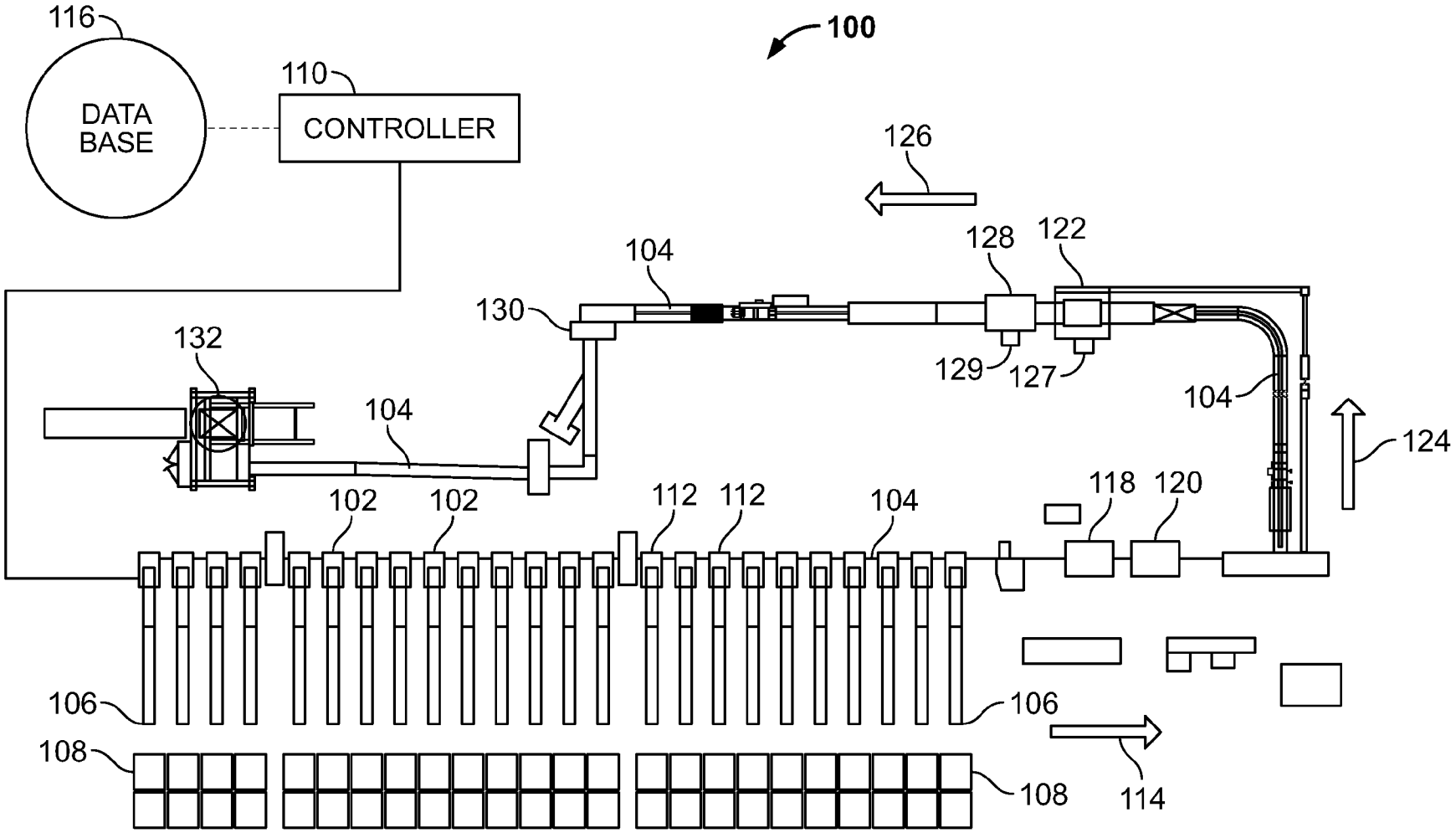
FIG. 1 is a schematic illustration of an example binding line that can be used to implement the examples disclosed herein.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

To maintain high quality readable addresses and/or bar codes, the examples disclosed herein address books of varying thickness by substantially maintaining a distance between a print head and a surface of a book being addressed. According to certain examples disclosed herein, a top surface of a book is to be presented at a substantially consistent height when passing under a print head, such as an ink jet head, on a mail table. As used herein, the phrase "a substantially similar distance," "substantially consistent height, "substantially the same," etc. means that the distance between a print head or labeler, etc. and varying thickness books does not prevent the address from being read (e.g., human readable address), scanned (e.g., machine readable address), etc. In some examples, a position of a book relative to the print head is selectively adjusted using a movable ramp and/or lift.

In some examples, the movable ramp is normally in a first and/or raised position to enable a top surface of thinner books to be positioned immediately adjacent a print head. However, the movable ramp is movable to a second and/or lowered position to enable a top surface of thicker books to be positioned immediately adjacent the print head if a thicker book is to be addressed. The ramp may be positioned in either the raised or lowered position based on information received from a thickness sensor, a code, and/or a print order. The ramp may or may not include a belt transport.

When a job is run and/or controlled using a controller, there may be a number of codes assigned to each of the various book makeups (e.g., having different signature numbers, signature selections, etc.). A database may store a record of each book to be processed and, within each record, a code may be stored indicating the makeup of and/or the signatures of a given book. The code, which is associated with a given book makeup, enables the controller to select which signatures should be chosen to create a particular book. Thus, the controller controls the respective signature devices. Alternatively, the record in the database may list the individual signatures to be fed to create a particular book as opposed to linking a code to a selection or a plurality of signatures.

In some examples, the movable ramp is normally in a first and/or lowered position to enable a top surface of thicker books to be positioned immediately adjacent a print head. However, the movable ramp is movable to a second and/or raised position to enable a top surface of thinner books to be positioned immediately adjacent the print head if a thinner book is to be addressed. The ramp may be positioned in either the raised or lowered positions based on information received from a thickness sensor, a code, and/or a print order. The ramp may or may not include a belt transport.

The examples disclosed herein may be used in binding lines, co-mailing lines and/or hybrid lines. In a hybrid line, books being assembled on a signature-by-signature basis are co-mailed with preassembled books. In a co-mailing line, sets of pre-assembled books may be produced without being addressed on separate binding lines and then brought together into a merging operation to maximize postal discounts using two or more titles in a run.

In a co-mailing operation, a controller database may identify recipient information as well as book height information that may be used to adjust the height of the respective book relative to the printer and/or addresser. The book height information may be indirectly indicated by a code or directly indicated by a book thickness entry in the database. In other examples, a sensor may be used adjacent the printing station to identify the book height and convey a signal that causes the height of the book relative to the printer and/or addresser to adjust.

FIG. 1 depicts an example binding system 100 that can be used to implement the examples disclosed herein. The binding system 100 includes signature feeders 102 positioned near or at a conveyor 104. The binding system 100 may include any number of signature feeders 102 positioned in any suitable position relative to the conveyor 104. In some examples, the signature feeders 102 are coupled to respective hoppers 106 that may hold at least one signature to be fed to the signature feeders 102. One or more of the hoppers 106 may be coupled to at least one additional hopper 108 positioned substantially perpendicular to, parallel to, behind or otherwise proximate at least one of the hoppers 106. The hopper 108 may increase the amount of signatures (e.g., signature capacity) that each of the hoppers 106 may hold. If an additional hopper 108 is coupled to at least one of the hoppers 106 (e.g., two additional hoppers 108 are coupled to the hopper 106), each of the signature feeders 102 is able to feed a plurality of different signatures onto the conveyor when, for example, the first additional hopper 108 has signatures associated with a first book and the second additional hopper 108 has signatures associated with a second book.

The binding system 100 includes a controller 110 that is communicatively coupled to the signature feeders 102 and/or any other device within the binding system 100. The controller 110 may determine the order (e.g., a first order, a second order, etc.) to deliver signatures to pockets and/or stations along the conveyor 104. The orders are based, at least in part, on recipient data (e.g., recipient addresses) of the recipients of the respective books, which may be stored in a database 116. In operation, a plurality of different recipient lists may be combined to generate a combined list (e.g., a single combined list) to optimize reductions in postal costs. Books on the list may be produced sequentially, alternating, etc.

Near the signature feeders 102, the conveyor 104 moves pockets 112 in a direction generally indicated by arrow 114. As the pockets 112 move in proximity to the front of the signature feeders 102, the respective signature feeders 102 may deliver a signature onto one or more of the pockets 112. As the pockets 112 move in front of the different signature feeders 102, the signatures may be stacked on top of one another, the last of which may correspond to a front and/or rear cover of a book.

In operation, some of the pockets 112 may be associated with a first book having a first thickness and/or trim size and some of the pockets 112 may be associated with a second book having a second thickness and/or trim size. Signatures that correspond to the first book may be delivered to a first pocket 112 and signatures that correspond to a second book may be delivered to a second pocket 112. In some examples, at least one of the signature feeders 102 is used to insert cards and/or inserts into both the first and second books. The first and second books may be different sizes, thicknesses and/or trims. Any particular book at one of the pockets 112 may have the same or different content than another book at another one of the pockets 112, even if the books have the same title.

To bind the signatures to produce a book, the binding system 100 includes a stitcher 118 that stitches the signatures together. In this example, the stitcher 118 is positioned between the signature feeders 102 and a rejecter 120. However, the stitcher 118 may be positioned elsewhere along the binding system 100. The stitcher 118 may create a saddle stitch or any other type of stitch to hold the signature pages together. Alternatively, pages may be glued together along a backbone of the book and then a cover may be positioned adjacent the backbone to produce a square back book.

The rejecter 120 may identify if a book meets predetermined criteria and/or if a book is defective. In some examples, a book may be defective for having the wrong number of signatures (e.g., too many or too few), misaligned signatures and/or one or more wrong signatures. If a book is defective, a replacement book may be reordered via the controller 110 at any time so that a replacement book is grouped with other books to receive a lower cost postage presort level. The reordered replacement book may be included in a bundle (e.g., a package) of other books with the same carrier route number, the same five digit postal code mailing address, the same first three digits of the postal code mailing address or the same state or provincial mailing address.

If a book is reordered, the controller 110 may change a first order (e.g., a first predetermined order) to a second or different order (e.g., a second predetermined order) to accommodate re-producing the defective book. The first and second orders may be different, the same or similar. In some examples, the controller 110 may cause the signature feeders 102 to leave one of the pockets 112 empty to ensure that the second order is achieved.

After the books have been stitched and checked, the conveyor (e.g., a single mail stream) 104 moves the pockets 112 toward a trimmer 122 in a direction generally indicated by arrows 124 and 126. All of the pockets 112 may have a book on them or some may be left empty (e.g., no book on them).

The trimmer 122 includes a plurality of cutters (e.g., blades, edges) that are adjusted to cut at least one of the edges of the different books so that all of the pages of the respective books have substantially the same dimensions and/or are flush with one another. The trimmer 122 may include a first station to cut a face of a book and a second station to cut a head and a foot of the book. However, the trimmer 122 may include any number of stations (e.g., 1, 2, 3, 4, etc.) to cut the different edges of the book.

The trimmer 122 may include a sensor (e.g., an eye detector) 127 to distinguish between the different book sizes. While the sensor 127 is depicted as adjacent the trimmer 122, the sensor 127 may be positioned in any position on the binding system 100. Additionally or alternatively, the controller 110 may associate and/or identify the different size books along the conveyor 104 and transmit this information to the trimmer 122.

The example binding system 100 also includes an example addresser 128 that may address books of varying thickness. The addresser 128 may be an imager (e.g., a printer), a print head, a labeler and/or any other suitable device. The addresser 128 customizes and/or personalizes the plurality of different books by addressing the books with the intended recipient's name, address and/or an associated bar code. The addresser 128 may be positioned at any point in the binding system 100 (e.g., between signature feeders 102). In an example in which the addresser 128 is positioned between signature feeders 102, based on the number of number of signatures fed prior to the position of the addresser 128, the print head may be adjusted according to a height of a partially formed book to be addressed.

In some examples, the addresser 128 may include a sensor 129 to distinguish between the different books, sizes and/or thicknesses. Additionally or alternatively, the controller 110 may associate and/or identify the different size books along the conveyor 104 and transmit this information to the addresser 128. Based on the information received, the addresser 128 accordingly positions a movable ramp. For example, if it is identified that the next book is a thicker book than a book presently being addressed, the ramp may be moved and/or positioned in a lowered position to enable a top surface of the thicker book to be positioned adjacent the printer. If it is identified that the next book is a thinner book than the current book being addressed, the ramp may be moved and/or positioned in a raised position to enable a top surface of the thinner book to be positioned adjacent the printer. Thus, regardless on the book thickness, the addresser 128 may print a high quality readable address on the book.

The addresser 128 may address an insert (not shown) that is to be inserted into the respective book. The addresser 128 and/or the sensor 129 may be located at another location on the binding system 100. The binding system 100 may have any number of addressers 128 (e.g., 1, 2, 3, etc.) to personalize the different books.

After the books are trimmed and addressed, the conveyor 104 leads to a stacker (e.g., a backend stacker) 130 that sorts and/or packages the books. The order in which the stacker 130 places and/or intermingles the different books may be an order that is the same as the first order, the second order or another order that attempts to optimize postal discounts. The stacker 130 groups the different books into packages (e.g., bundles) that have the same mailing presort level. The binding system 100 may have any number of stackers (e.g., 1, 2, 3, etc.). While the above examples describe sorting first and second books, the example binding system 100 may produce any number of different books (e.g., a first book, a second book, a third book, etc.) at the same time. In this example, after the different books are packaged, the packages move along the conveyor 104 to a palletizer 132 that places the different packages onto pallets for shipment.

Figure 2:
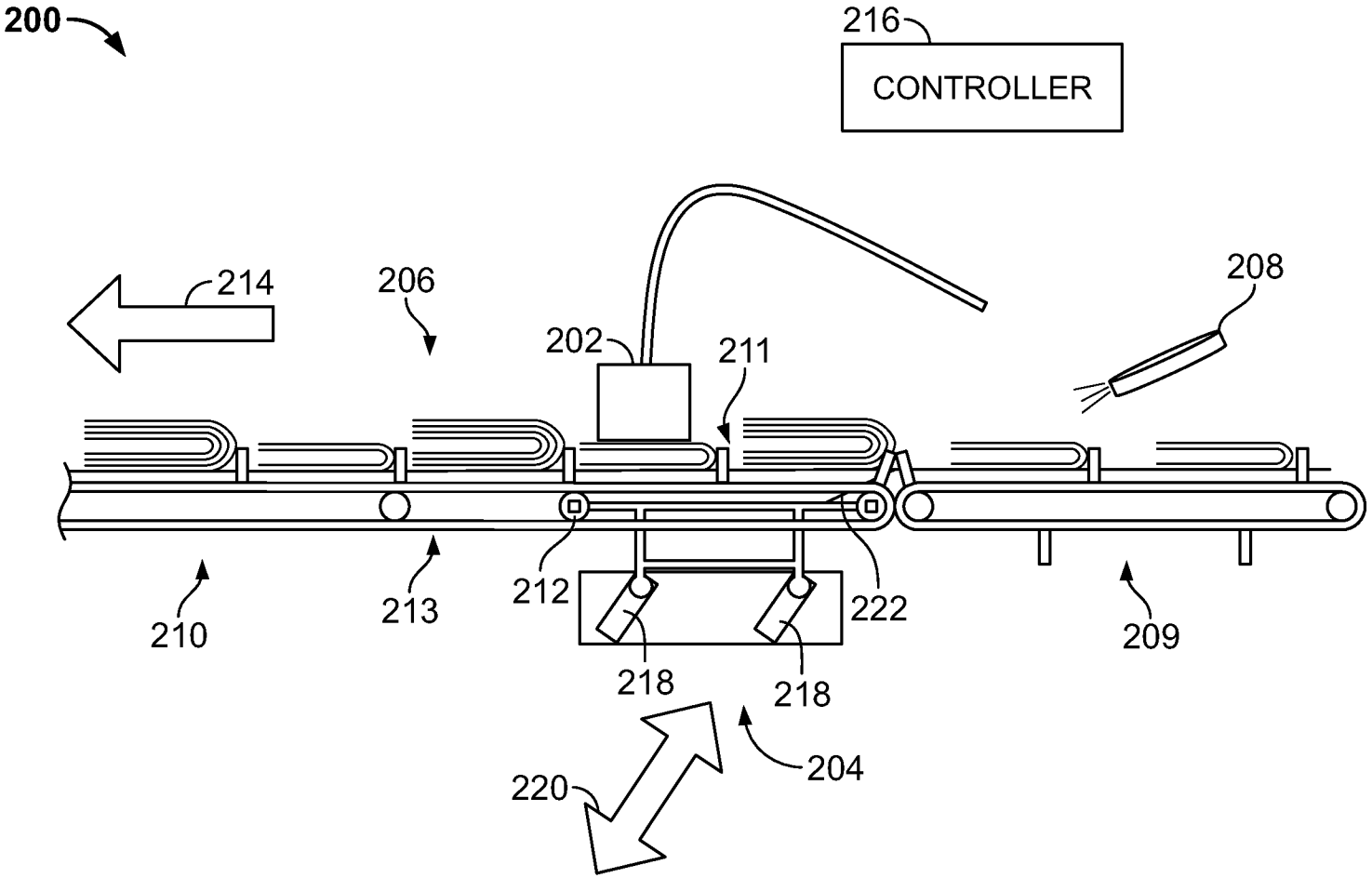
FIGS. 2 and 3 depict an example addresser that can be used to implement the examples disclosed herein.
Figure 3:
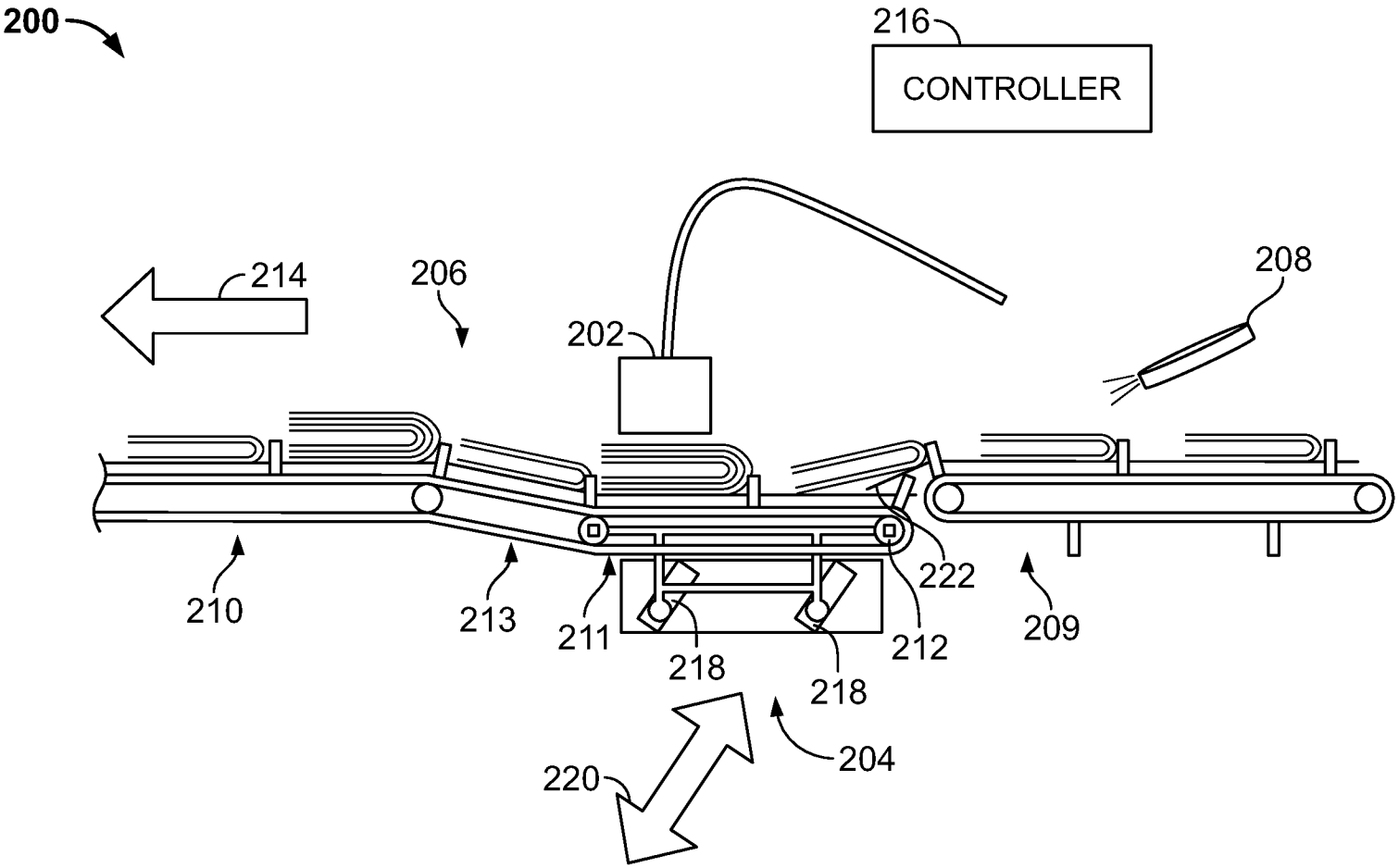

FIGS. 2 and 3 illustrate a side view of an example addresser 200 that can be used to implement the examples disclosed herein. The addresser 200 includes a printer, print head and/or labeler 202, an adjustable lift 204, a conveyor 206 and a sensor 208. The conveyor 206 includes a first conveyor portion 209 and a second conveyor portion 210 operably coupled to the adjustable lift 204. The second conveyor portion 210 includes a first portion 211 having rollers 212 and a second portion 213. The first portion 211 is substantially vertically moveable via the adjustable lift 204 between raised, intermediate and/or lowered positions. The second portion 213 at least partially pivots relative to the first portion 211 as the first portion 211 moves between the positions.

In operation, as books of different thicknesses proceed in a direction generally indicated by arrow 214, the sensor 208 determines a thickness of the book. The sensor 208 conveys the book thickness information to a controller 216, which in turn causes the adjustable lift 204 to remain or move to the lowered or raised position.

If the book thickness information is related to a book being relatively thin (FIG. 2), the controller 216 causes the adjustable lift 204 to move and/or remain in the raised position to enable a top surface of the thinner book to be positioned immediately adjacent the printer 202. If the book thickness information is related to a book being relatively thick (FIG. 3), the controller 216 causes the adjustable lift 204 to move and/or remain in the lowered position to enable a top surface of the thicker book to be positioned immediately adjacent the printer 202. The adjustable lift 204 is guidable and/or movable within guide slots 218 in directions generally indicated by arrow 220. In this example, a ramp 222 is positioned between the first and second conveyor portions 209 and 210 to enable a relatively smooth transition between the first and second conveyor portions 209 and 210 at least when the adjustable lift 204 is in the lowered position.

Figure 4:
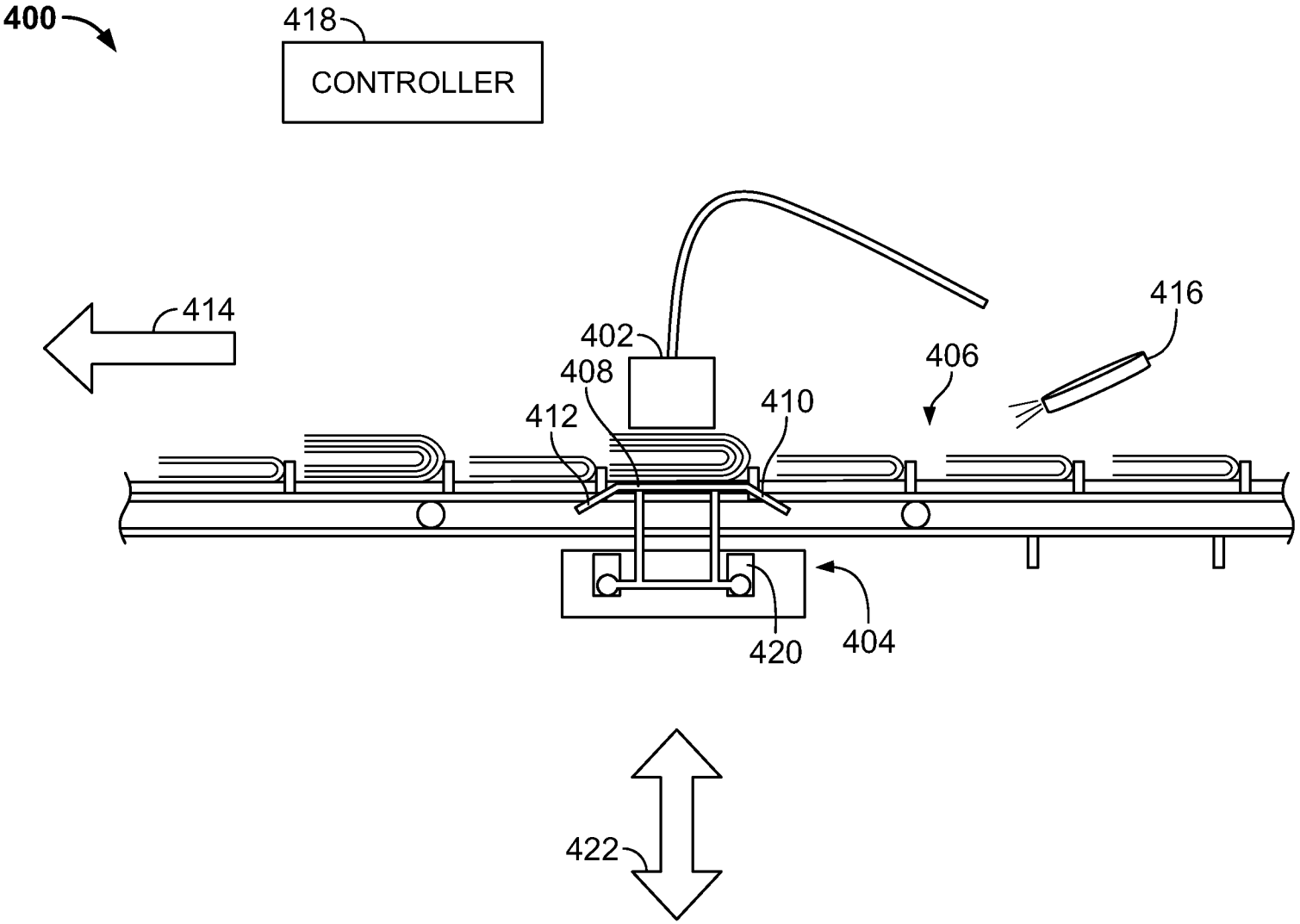
FIGS. 4 and 5 depict another example addresser that can be used to implement the examples disclosed herein.
Figure 5:
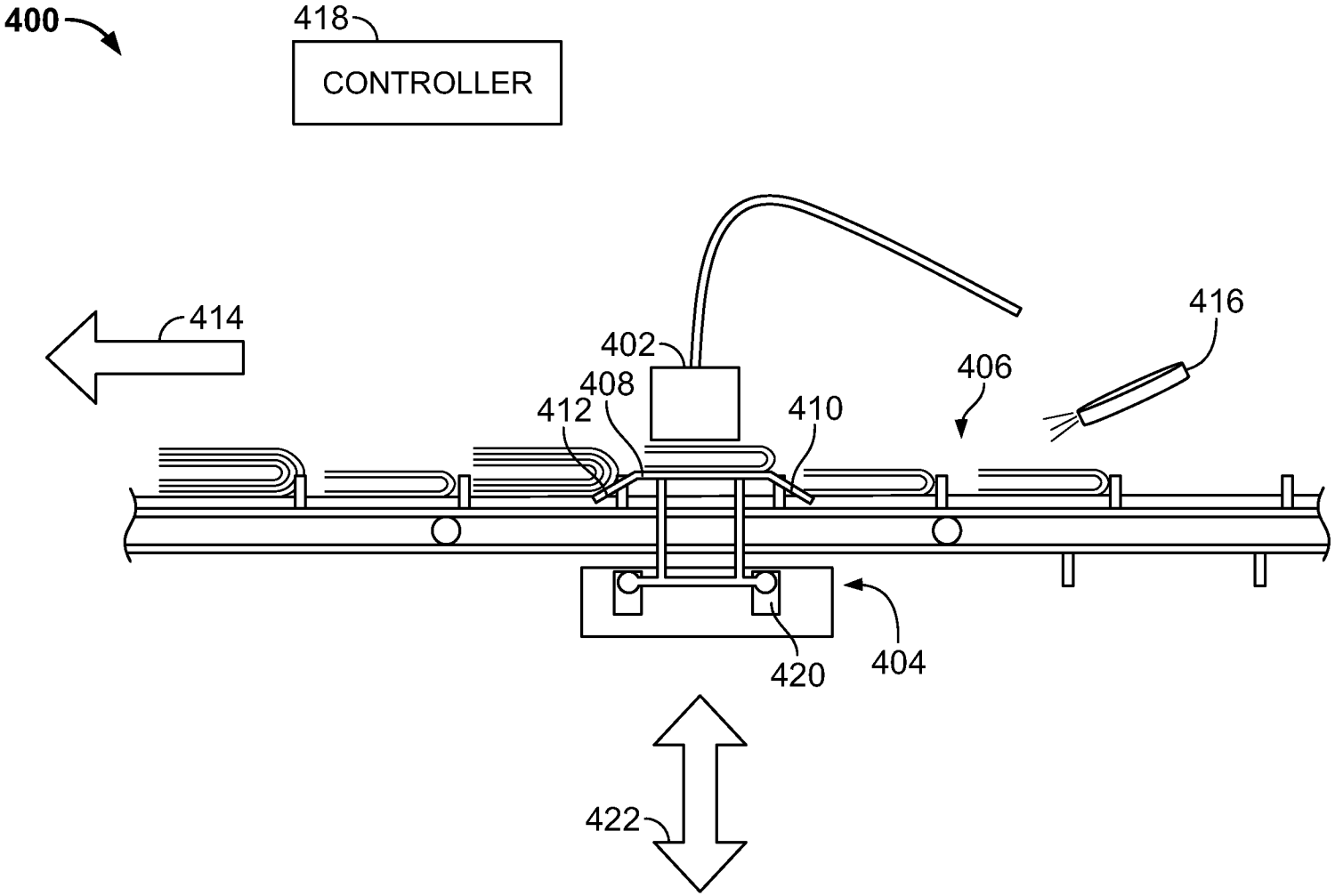

FIGS. 4 and 5 illustrate a side view of an example addresser 400 that can be used to implement the examples disclosed herein. The addresser 400 includes a print head and/or labeler 402, an adjustable lift 404 and a conveyor 406. The adjustable lift 404 includes a platform or portion 408 having tapered surfaces 410, 412 to enable a relatively smooth transition between the conveyor 406 and the platform 408 when the adjustable lift 404 is in the raised position.

In operation, as books of different thicknesses proceed in a direction generally indicated by arrow 414, a sensor 416 determines a thickness of the book. The sensor 416 conveys the book thickness information to a controller 418, which in turn causes the adjustable lift 404 to remain or move to the lowered or raised position.

If the book thickness information is related to a book being relatively thick (FIG. 4), the controller 418 causes the adjustable lift 404 to move and/or remain in the lowered and/or normal position to enable a top surface of the thicker book to be positioned immediately adjacent the printer 402. If the book thickness information is related to a book being relatively thin (FIG. 5), the controller 418 causes the adjustable lift 404 to move and/or remain in the raised position to enable a top surface of the thinner book to be positioned immediately adjacent the printer 202. When addressing a thinner book, the adjustable lift 404 may remain raised and/or raise prior to and/or after the thinner book is beneath the printer 402. The adjustable lift 404 is guidable and/or movable within guide slots 420 in directions generally indicated by arrow 422.

Figure 6:
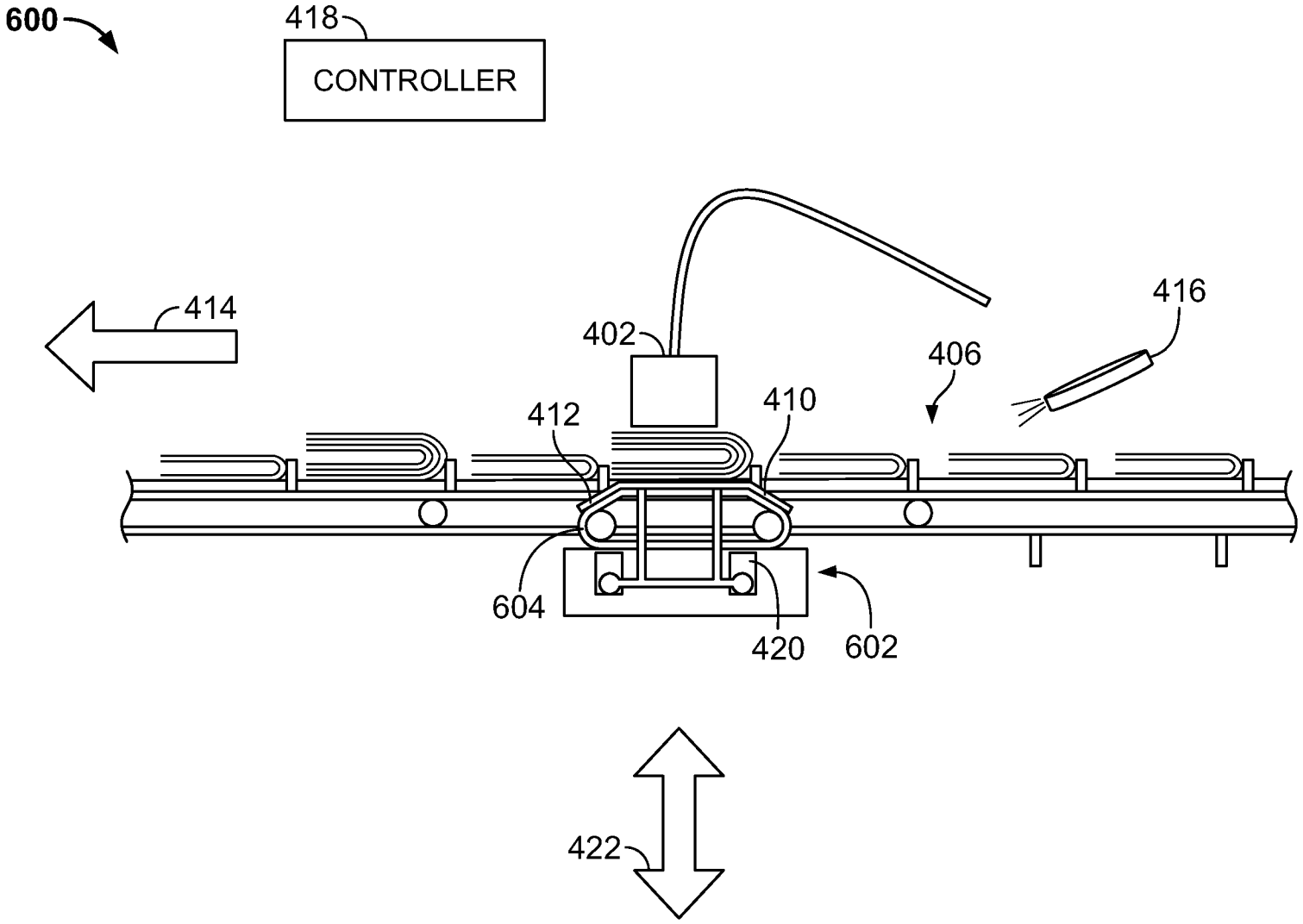
FIGS. 6 and 7 depict another example addresser that can be used to implement the examples disclosed herein.
Figure 7:
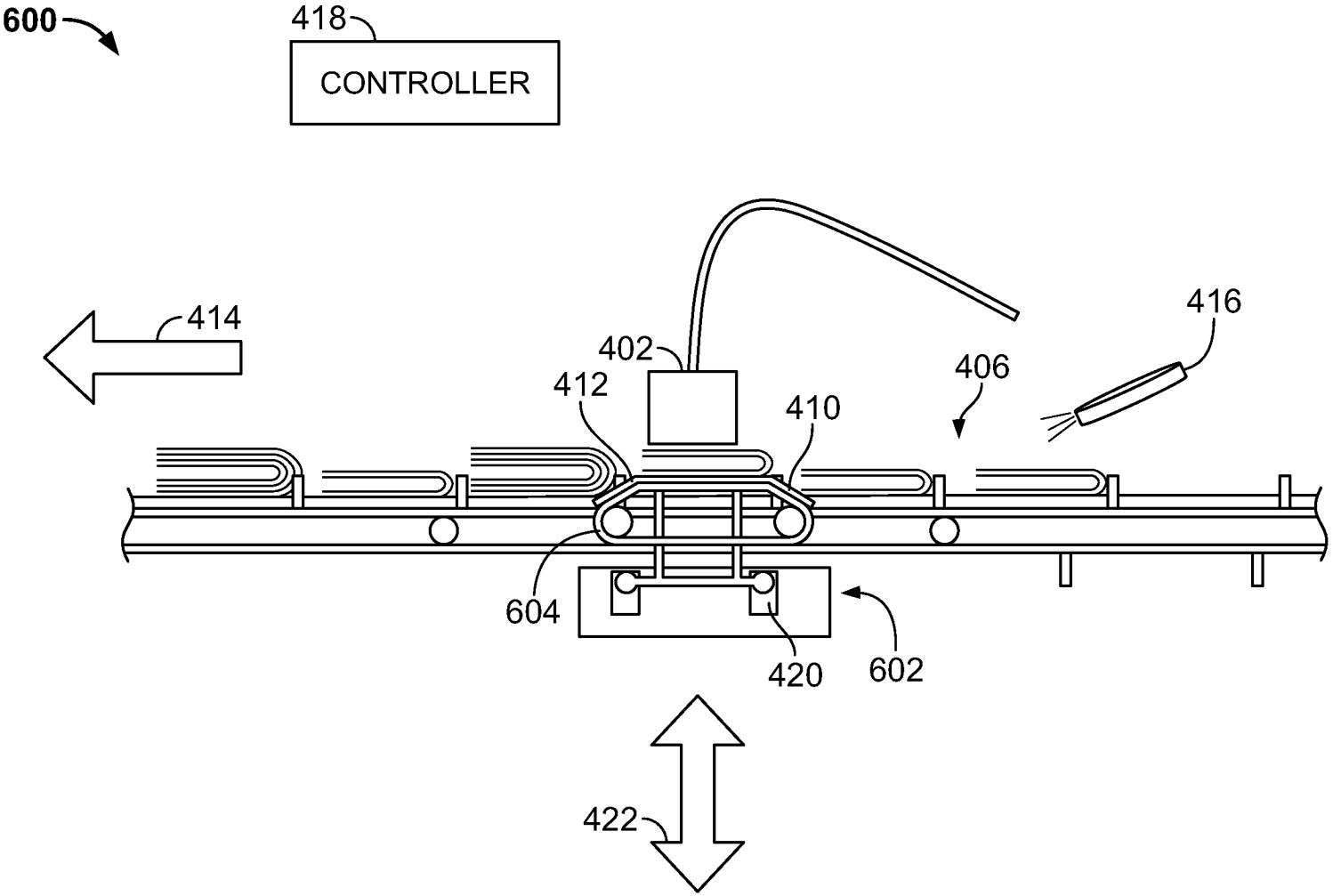

FIGS. 6 and 7 illustrate a side view of an example addresser 600 that can be used to implement the examples disclosed herein. The example addresser 600 of FIG. 6 is similar to the addresser 400 of FIG. 4. However, in contrast, the addresser 600 includes an adjustable lift 602 having a transport assembly and/or belt 604. The transport belt 604 moves books being addressed relative to the printer 402. When addressing a thinner book, the adjustable lift 602 may remain raised and/or raise prior to and/or after the thinner book is beneath the printer 402.

While the examples disclosed herein discuss moving the adjustable lift between a raised position and a lowered position corresponding to a thinner book and a thicker book, the adjustable lift may be moved between any number of positions (e.g., 2, 3, 4, etc.) to addresses a corresponding number of books having different thicknesses.

Figure 8:
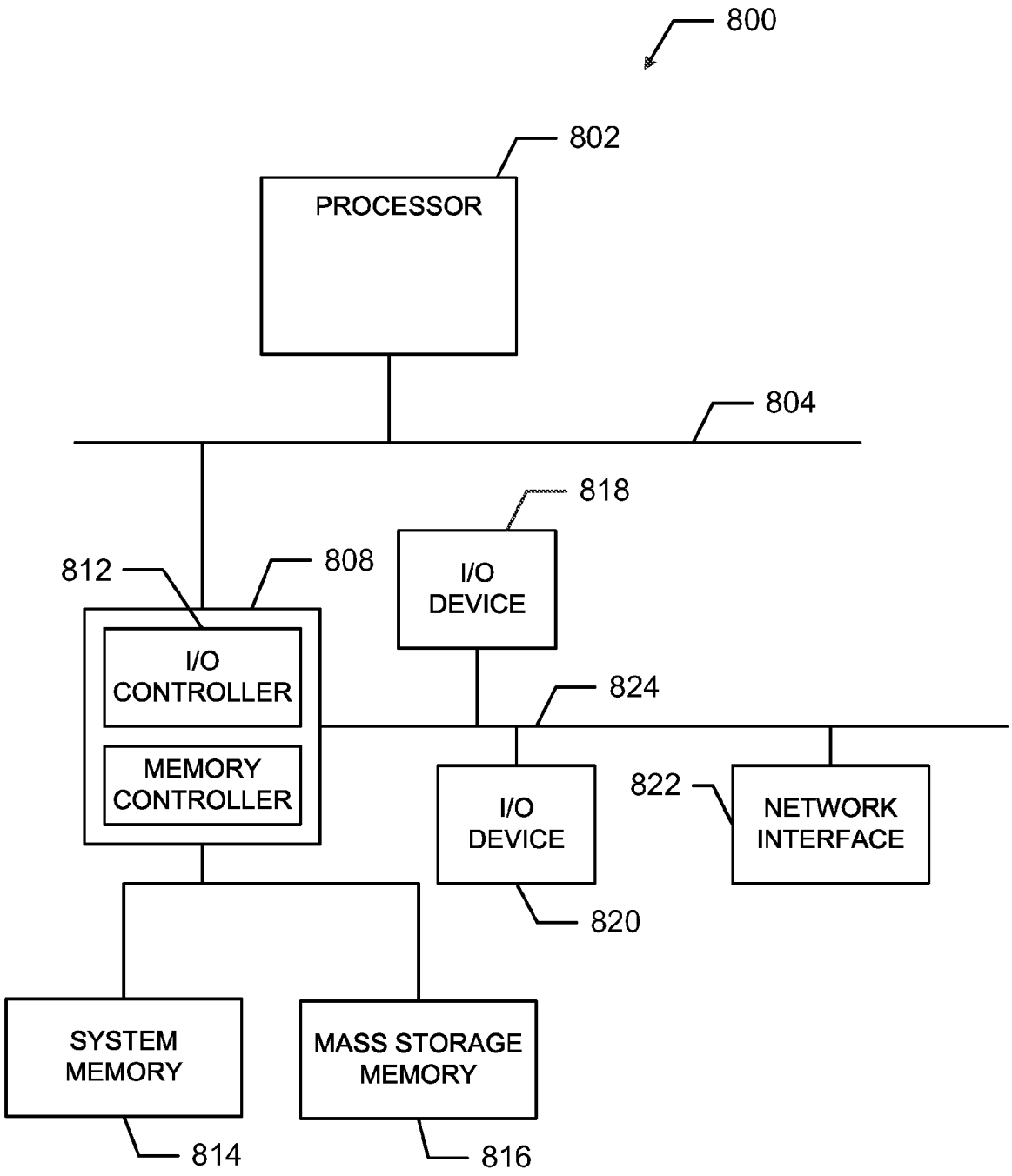
FIG. 8 is a schematic illustration of an example processor platform that may be used and/or programmed to implement any or all of the examples disclosed herein.

FIG. 8 is a block diagram of an example processor system 800 that may be used to implement the examples disclosed herein. As shown in FIG. 8, the processor system 800 includes a processor 802 that is coupled to an interconnection bus 804. The processor 802 may be any suitable processor, processing unit or microprocessor. Although not shown in FIG. 8, the processor system 800 may be a multi-processor system and, thus, may include one or more additional processors that are identical or similar to the processor 802 and that are communicatively coupled to the interconnection bus 804.

The processor 802 of FIG. 8 is coupled to a chipset 808, which includes a memory controller 820 and an input/output (I/O) controller 812. As is well known, a chipset typically provides I/O and memory management functions as well as a plurality of general purpose and/or special purpose registers, timers, etc. that are accessible or used by one or more processors coupled to the chipset 808. The memory controller 810 performs functions that enable the processor 802 (or processors if there are multiple processors) to access a system memory 814 and a mass storage memory 816.

The system memory 814 may include any desired type of volatile and/or non-volatile memory such as, for example, static random access memory (SRAM), dynamic random access memory (DRAM), flash memory, read-only memory (ROM), etc. The mass storage memory 816 may include any desired type of mass storage device including hard disk drives, optical drives, tape storage devices, etc.

The I/O controller 812 performs functions that enable the processor 802 to communicate with peripheral input/output (I/O) devices 818 and 820 and a network interface 822 via an I/O bus 824. The I/O devices 818 and 820 may be any desired type of I/O device such as, for example, a keyboard, a video display or monitor, a mouse, etc. The network interface 822 may be, for example, an Ethernet device, an asynchronous transfer mode (ATM) device, an 802.11 device, a DSL modem, a cable modem, a cellular modem, etc. that enables the processor system 800 to communicate with another processor system.

While the memory controller 810 and the I/O controller 812 are depicted in FIG. 8 as separate functional blocks within the chipset 808, the functions performed by these blocks may be integrated within a single semiconductor circuit or may be implemented using two or more separate integrated circuits.

As set forth herein, an example book addresser includes a print head to address books having different thicknesses and a lift movable relative to the print head between a first position and a second position to substantially maintain a distance between the print head and an addressing surface of the respective books.

In some examples, the book addresser also includes a sensor to identify a first book thickness or a second book thickness. The lift is to be in the first position or the second position based on the first book thickness or the second book thickness being identified. In some examples, the lift includes tapered surfaces and a platform between the tapered surfaces. At least one of the books having the first book thickness or the second book thickness to be positioned on the platform when being addressed. In some examples, the addresser also includes a first conveyor portion and a second conveyor portion, the second conveyor portion includes the lift.

In some examples, the addresser also includes a ramp to transition the books between the first conveyor portion and the second conveyor portion when the lift is in at least one of the first position or the second position. In some examples, the first conveyor portion includes a first transport belt and the second conveyor portion includes a second transport belt different from the first transport belt. In some examples, the addresser also includes guide slots within which a portion of the lift is positioned to guide movement of the lift between the first position and the second position. In some example, the lift includes a transport belt to move the varying thickness books relative to the print head.

An example mailing line includes a lift to substantially maintain a distance between an addresser and an addressing surface of books having different thicknesses and a processor to cause the lift to move to a first position or a second position based on an order in which the books are being simultaneously produced. The first position is associated with a first book thickness and the second position is associated with a second book thickness different than the first book thickness. In some examples, the mailing line includes binding line, a co-mailing line, or a mail table. In some examples, the order includes a co-mailing order. In some examples, the lift includes tapered surfaces and a platform between the tapered surfaces. At least one of the books having the first book thickness or the second book thickness to be positioned on the platform when being addressed.

In some examples, the mailing line also includes a first conveyor portion and a second conveyor portion. The second conveyor portion includes the lift. In some examples, the mailing line also includes a ramp to transition the books between the first conveyor portion and the second conveyor portion when the lift is in at least one of the first position or the second position. In some examples, the first conveyor portion includes a first transport belt and the second conveyor portion includes a second transport belt different from the first transport belt. In some examples, the mailing line also includes guide slots within which a portion of the lift is positioned to guide movement of the lift between the first position and the second position. In some examples, the lift includes a transport belt to move the varying thickness books relative to the print head.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A book addresser, comprising:

a print head to address books having different thicknesses;

a conveyor to move the books toward the print head, the conveyor to pass beneath the print head; and a lift comprising:

a first inclined surface;

a second inclined surface; and a platform disposed between the first and second inclined surfaces, the lift movable relative to the print head between a first position and a second position to substantially maintain a distance between the print head and an addressing surface of the respective books, in the second position, the platform is disposed between the print head and the conveyor, the lift being independently movable relative to the conveyor.

2. The book addresser of claim 1, further comprising a sensor to identify a first book thickness or a second book thickness, the lift to be in the first position or the second position based on the first book thickness or the second book thickness being identified.

3. The book addresser of claim 2, wherein at least one of the books having the first book thickness or the second book thickness to be positioned on the platform when being addressed.

4. The book addresser of claim 1, wherein the conveyor comprises a first conveyor, further comprising a second conveyor disposed on the lift.

5. The book addresser of claim 4, wherein the first and second inclined surfaces transition the books between the first conveyor and the second conveyor when the lift is in at least one of the first position or the second position.

6. The book addresser of claim 4, wherein the first conveyor comprises a first transport belt and the second conveyor comprises a second transport belt different from the first transport belt.

7. The book addresser of claim 1, further comprising guide slots within which a portion of the lift is positioned to guide movement of the lift between the first position and the second position.

8. The book addresser of claim 1, wherein the lift comprises a transport belt to move the books having different thicknesses relative to the print head, wherein the transport belt is different from the conveyor.

9. A mailing line, comprising:

a conveyor to move books toward an addresser, the conveyor to pass beneath the addresser;

a lift to substantially maintain a distance between the addresser and an addressing surface of the books having different thicknesses, the lift is disposed beneath the addresser, the lift is independently movable relative to the conveyor; and a processor to cause the lift to move to a first position or a second position based on an order in which the books are being simultaneously produced, the first position associated with a first book thickness and the second position associated with a second book thickness different than the first book thickness, in the second position, the lift is disposed between the addresser and the conveyor.

10. The mailing line of claim 9, wherein the mailing line comprises a binding line, a co-mailing line, or a mail table.

11. The mailing line of claim 9, wherein the order comprises a co-mailing order.

12. The mailing line of claim 9, wherein the lift comprises tapered surfaces and a platform between the tapered surfaces, at least one of the books having the first book thickness or the second book thickness to be positioned on the platform when being addressed.

13. The mailing line of claim 9, wherein the conveyor comprises a first conveyor, further comprising a second conveyor disposed on the lift.

14. The mailing line of claim 13, further comprising a ramp to transition the books between the first conveyor and the second conveyor when the lift is in at least one of the first position or the second position.

15. The mailing line of claim 13, wherein the first conveyor comprises a first transport belt and the second conveyor comprises a second transport belt different from the first transport belt.

16. The mailing line of claim 9, further comprising guide slots within which a portion of the lift is positioned to guide movement of the lift between the first position and the second position.

17. The mailing line of claim 9, wherein the lift comprises a transport belt to move the books having different thickness relative to the addresser.

* * * * *